US008016388B2

(12) United States Patent
Toge et al.

(10) Patent No.: US 8,016,388 B2
(45) Date of Patent: Sep. 13, 2011

(54) INK JET RECORDING HEAD

(75) Inventors: Yoshiyuki Toge, Yokohama (JP); Hiroshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 937 days.

(21) Appl. No.: 11/958,654

(22) Filed: Dec. 18, 2007

(65) Prior Publication Data

US 2008/0143788 A1 Jun. 19, 2008

(30) Foreign Application Priority Data

Dec. 19, 2006 (JP) ..... 2006-341270
Oct. 19, 2007 (JP) ..... 2007-272677

(51) Int. Cl.
*B41J 2/14* (2006.01)
*B41J 2/16* (2006.01)

(52) U.S. Cl. ..... 347/50; 347/29

(58) Field of Classification Search ..... 347/22, 347/29, 50, 58, 59, 64, 65, 71, 85–86
See application file for complete search history.

(56) References Cited

U.S. PATENT DOCUMENTS

| | | | | |
|---|---|---|---|---|
| 5,189,787 | A | 3/1993 | Reed et al. | |
| 6,644,780 | B2 * | 11/2003 | Lodal et al. | 347/37 |
| 7,309,120 | B2 | 12/2007 | Hatsui et al. | |
| 2005/0285904 | A1 | 12/2005 | Toge et al. | |
| 2007/0103501 | A1 | 5/2007 | Hatsui et al. | |

FOREIGN PATENT DOCUMENTS

| | | |
|---|---|---|
| JP | 2001-63053 | 3/2001 |
| JP | 2001-63057 | 3/2001 |
| JP | 2002-254661 | 9/2002 |

* cited by examiner

*Primary Examiner* — Thinh H Nguyen
(74) *Attorney, Agent, or Firm* — Fizpatrick, Cella, Harper & Scinto

(57) ABSTRACT

An ink jet recording head is constituted by a recording element substrate provided with an energy generating element for generating energy for ejecting ink from an ink ejection outlet, an electric wiring member electrically connected with the recording element substrate, a mounting portion for mounting the recording element substrate, and an opening provided in the mounting portion. The electric wiring member penetrates through the opening.

4 Claims, 8 Drawing Sheets

INK JET RECORDING HEAD

FIELD OF THE INVENTION AND RELATED ART

The present invention relates to an ink jet recording head used in an ink jet recording apparatus for performing a recording operation by ejecting a liquid such as ink or the like.

The ink jet recording head mounted to the ink jet recording apparatus includes an ink ejection outlet for ejecting an ink droplet therefrom and a supply system for supplying ink to the ink ejection outlet. To an ejection energy generating element (e.g., an electrothermal transducer element or an electromechanical vibration transducer element) provided corresponding to the ink ejection outlet, an electric signal as a recording signal is supplied thereby to generate an ejection pressure. The thus generated ejection pressure causes a minute ink droplet for effecting recording with respect to a recording medium to be ejected from a minute ink ejection outlet.

A recording apparatus provided with such an ink jet recording head is capable of outputting high quality character and graphic images inexpensively, thus now constituting the majority in the printer market. Japanese Laid-Open Patent Application (JP-A)2002-254661 discloses a currently representative structural embodiment of an ink jet recording head used in an expensive ink jet recording apparatus.

Further, as described in JP-A 2001-63053 and JP-A 2001-63057, to an ink jet recording head, a flexible wiring substrate is attached so as to surround a recording element substrate provided with an ink ejection outlet to form a flat surface. When a recording operation is not performed for some time, in order to prevent vaporization of ink from the ink ejection outlet, the ink ejection outlet is blocked from an external environment by bringing a capping member of a main assembly of a recording apparatus into contact with the flat surface.

FIG. 8 is a perspective view of a conventional ink jet recording head used in an ink jet recording apparatus when viewed from a mounting side of a recording element substrate. Referring to FIG. 8, an ink jet recording head 2001 is principally constituted by a recording element substrate 2101 provided with an ink ejection outlet 2103, a flexible wiring substrate 2301, and an ink retaining portion 2501 for retaining ink. Of these constituents, the recording element substrate 2101 is a most expensive part, thus being prepared so as to reduce its size as small as possible. The flexible wiring substrate 2301 which is a secondary expensive part accommodates the recording element substrate 2101 at its opening 2302 and is electrically connected with the recording element substrate 2301. Further, the flexible wiring substrate 2301 forms a contact surface with respect to an elastic capping member, provided to a main assembly of an ink jet recording apparatus, for covering and sealing the ink ejection outlet 2103 in order to prevent the ink from vaporizing through the ink ejection outlet 2103 during non-recording. A broken line 2310 shown in FIG. 8 represents a portion at which an end of the capping member is contactable with the flexible wiring substrate 2301. The end of the capping member covers and seals the ink ejection outlet by contacting the flexible wiring substrate 2301 so as to surround the recording element substrate 2101. For this reason, even when downsizing of the recording element substrate, high density electric wiring, and reduction in the number of wiring leads are advanced, a cap contact surface having a certain area is required at the surface of the flexible wiring substrate, so that the flexible wiring substrate cannot be downsized significantly. If the flexible wiring substrate is downsized so as to be accommodated with the broken line 2310, when the flexible wiring substrate is extended to an electrical connection portion located at a side surface of the ink retaining portion 2501, a point at which the flexible wiring substrate intersects the broken line 2310 is generated. In this case, a stepped portion is formed on the broken line 2310 at a boundary between a portion where the capping member can directly contact the ink retaining portion 2501 and a portion where the capping member can indirectly contact the ink retaining portion 2501 through the flexible wiring substrate 2301, so that leakage from this stepped portion lowers a sealing performance of the capping member.

SUMMARY OF THE INVENTION

A principal object of the present invention is to form a cap contact surface by a simple constitution without requiring a new part.

An object of the present invention is to provide an ink jet recording head capable of forming such a cap contact surface.

According to an aspect of the present invention, there is provided an ink jet recording head comprising:

a recording element substrate provided with an energy generating element for generating energy for ejecting ink from an ink ejection outlet;

an electric wiring member electrically connected with the recording element substrate;

a mounting portion for mounting the recording element substrate; and an opening provided in the mounting portion, wherein the electric wiring member penetrates the opening.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4A, 4B and 4C are schematic views showing an ink retaining portion or a capping member, wherein FIG. 4A is a side view showing a part of the ink retaining portion, FIG. 4B is a bottom view of the ink retaining portion as seen from an ink supply port side, and FIG. 4C is a schematic perspective view of the capping member.

DETAILED DESCRIPTION OF THE PREFERRED EMBODIMENTS

Hereinbelow, embodiments of the present invention will be described with reference to the drawings.

Figure 1:
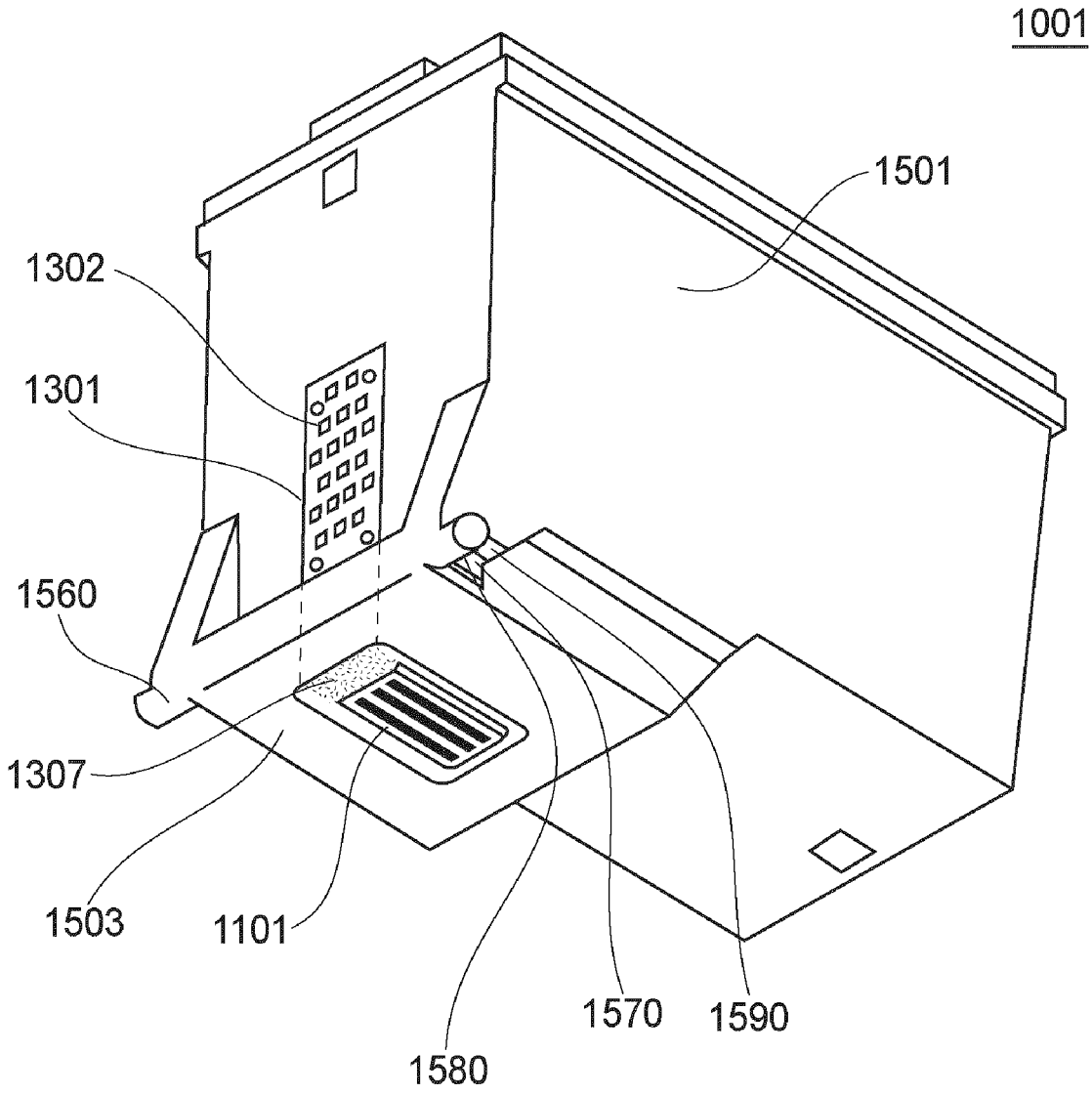
FIG. 1 is a perspective view showing a mounting side of a recording element substrate of an ink jet recording head according to an embodiment of the present invention.

A recording head of this embodiment is integrally constituted with an ink container (tank) as shown in FIG. 1. An ink jet recording head 1001 shown in FIG. 1 retains liquid color inks (cyan ink, magenta ink and yellow ink). This ink jet recording head 1001 is fixedly supported by a positioning means and electrical contacts of a carriage mounted to a main assembly of an ink jet recording apparatus. The ink jet recording head 1001 is detachably mountable to the carriage and is replaced when the ink retained therein is consumed.

Figure 2:
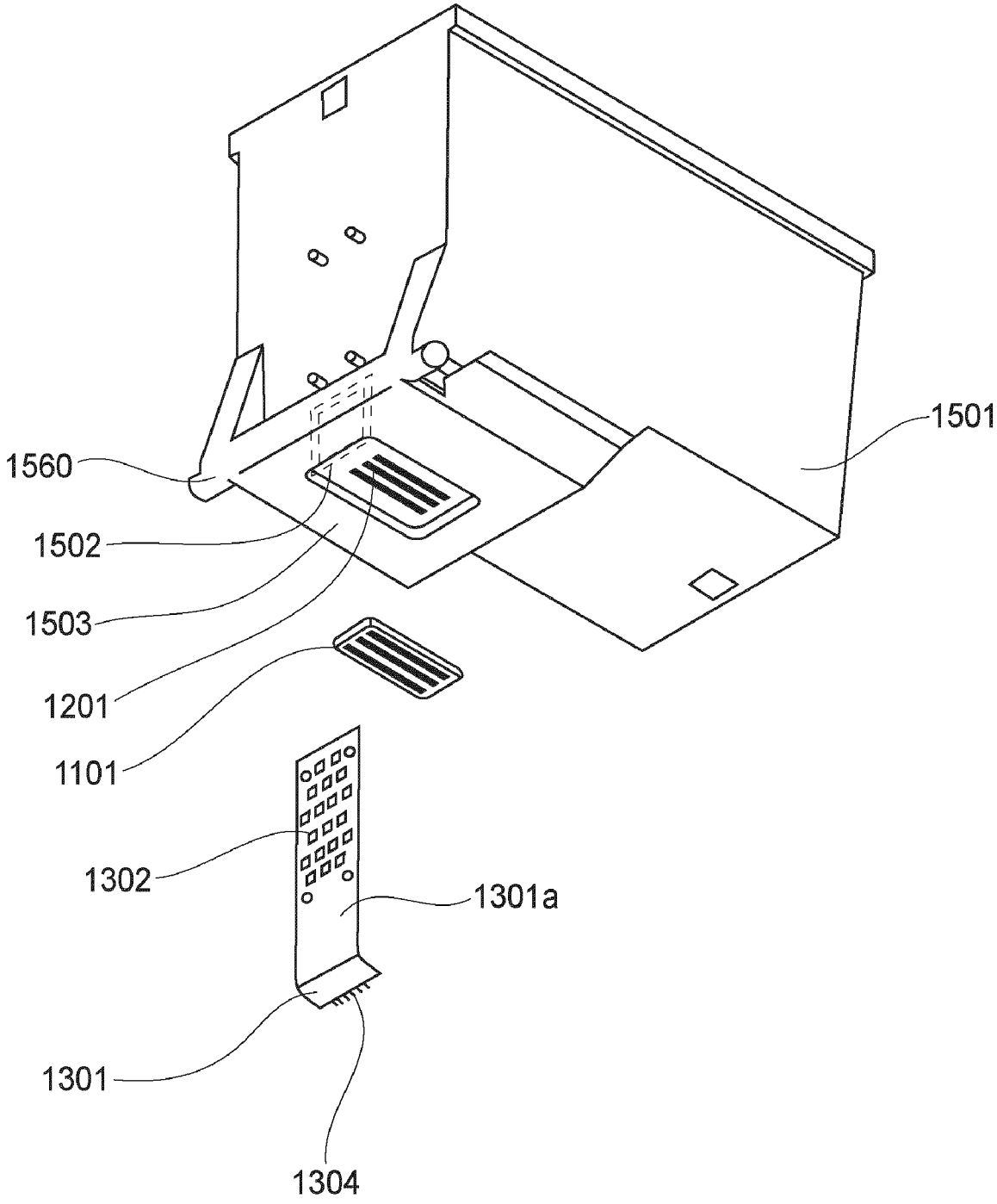
FIG. 2 is an exploded perspective view showing the recording element substrate mounting side.

Constituents of the ink jet recording head 1001 are shown in an exploded perspective view of FIG. 2. The ink jet recording head 1001 is constituted by a recording element substrate 1101, an electric wiring tape (flexible electric wiring substrate) 1301 as an electric wiring member, an ink retaining portion 1501, etc.

Figure 3:
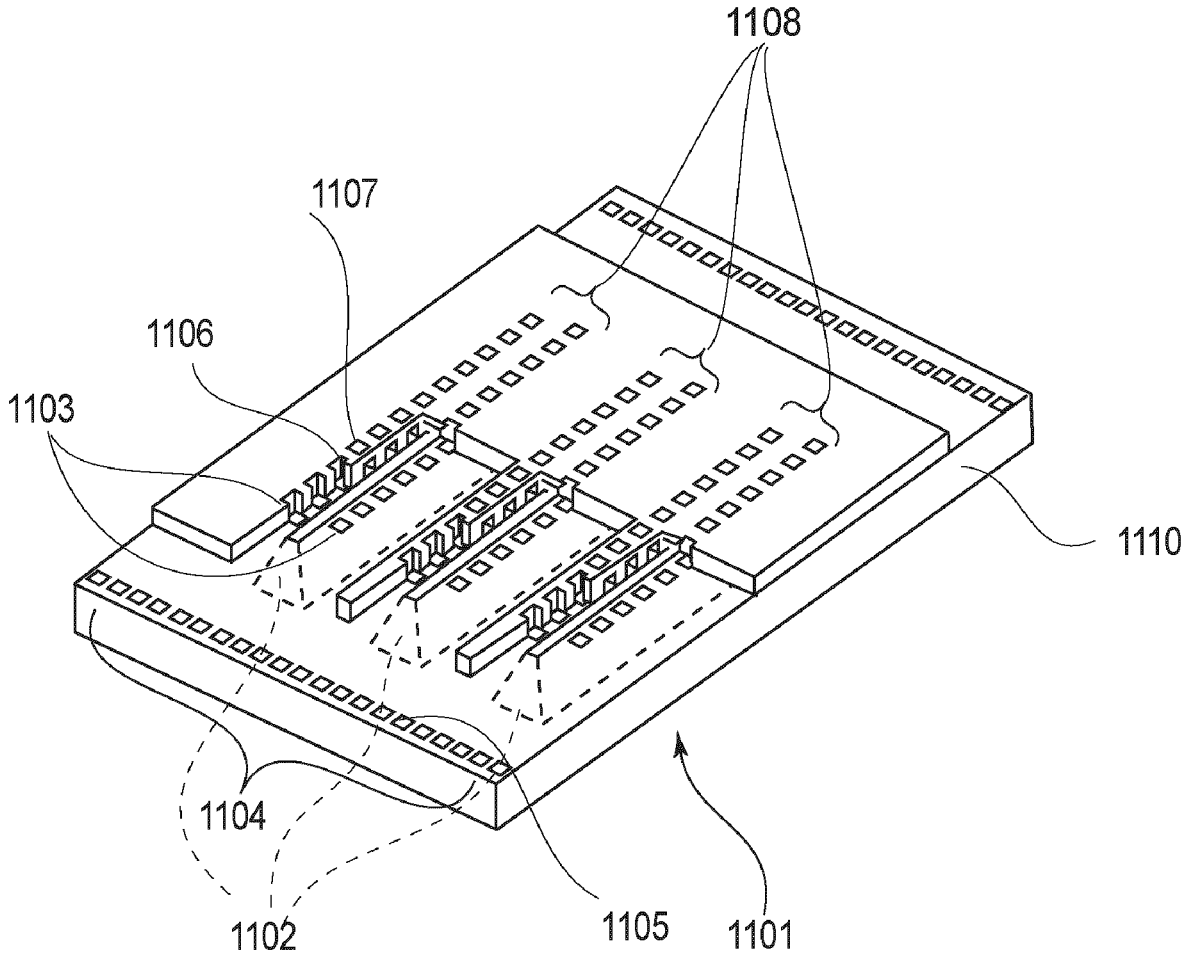
FIG. 3 is a partly broken perspective view showing the recording element substrate.

FIG. 3 is a partly broken perspective view for illustrating a constitution of the recording element substrate 1101 on which three ink supply ports 1102 for cyan, magenta and yellow are formed in parallel to each other. At both sides of each ink supply port 1102, a plurality of electrothermal transducer elements 1103 as energy generating elements and a plurality of ink ejection outlets 1107 are formed and arranged in lines, respectively. On an Si substrate 1110, in addition to the electrothermal transducer elements 1103, electrical members such as electric wiring, an electrical circuit and an electrode portion 1104, are formed. On these members, ink flow passage walls 1106 and the ink ejection outlets 1107 are formed of a resinous material through a photolithographic technique. The electrode portion 1104 for supplying electric power to the electric wiring is located along one side of the recording element substrate 1101 having a rectangular (parallelogram) shape.

Referring to FIG. 2, the electric wiring tape 1301 is constituted by forming a copper foil wiring pattern on a polyimide base material and forms an electric signal path through which an electric signal for ejecting the ink is applied to the recording element substrate 1101. The electric wiring tape 1301 has an L shape such that it is bent about 90 degrees along an outer surface of a casing of the ink retaining portion 1501, and at an end portion of a short side of the electric wiring tape 1301, an electrode terminal portion 1304 is provided to be connected to the electrode portion 1104 of the recording element substrate 1101. Further, at a long side of the electric wiring tape 1301, an external signal input terminal 1302 for receiving an electric signal from the apparatus main assembly is formed and connected with the electrode terminal portion 1304 through a continuous copper foil wiring pattern.

The ink retaining portion 1501 shown in FIG. 2 is formed of, e.g., "NORYL" (registered trademark) resin by resin molding.

Figure 4A:
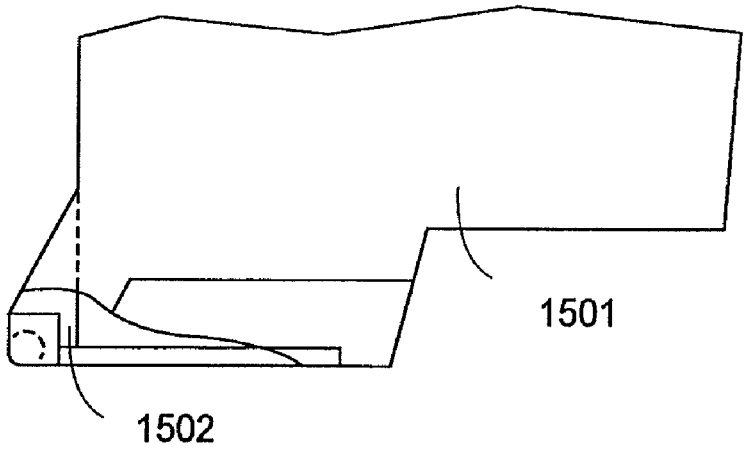
Figure 4B:
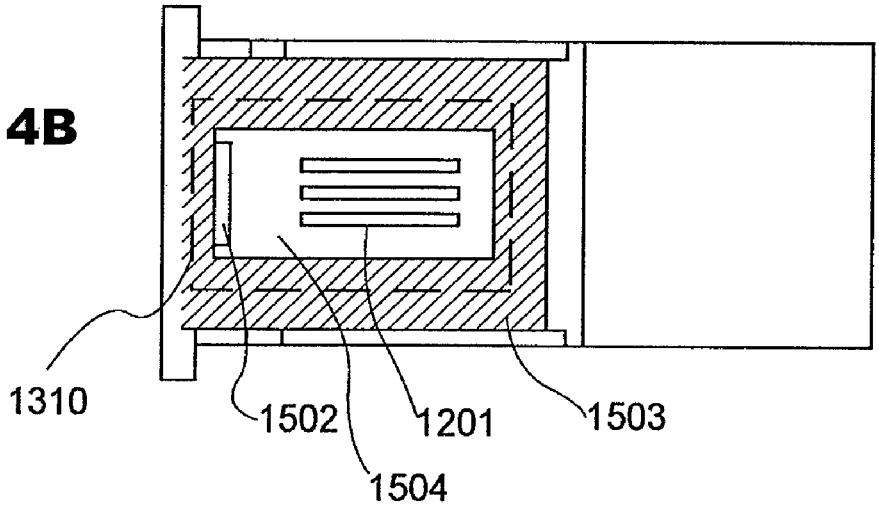
Figure 4C:
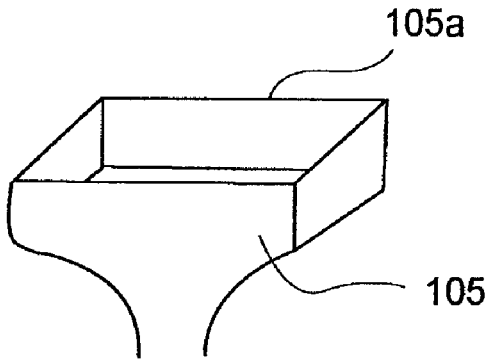

FIG. 4A is a schematic view showing a part of a side surface of the ink retaining portion 1501 and FIG. 4B is a bottom view of the ink retaining portion 1501 as seen from an ink supply port 1201 side. At a mounting surface 1504 as a (mounting) portion at which the recording element substrate 1101 is adhered and mounted, the ink supply ports are opened. The ink retaining portion 1501 has a contact surface 1503 projected toward an ink ejection direction compared with the mounting surface 1504 for mounting the recording element substrate 1101. This contact surface 1503 is a surface having a contact portion directly contactable with an end 105*a* (FIG. 4C) of the capping member 105 and surrounds the mounting surface 1504 for mounting the recording element substrate 1101. Further, a slit 1502 is open at the mounting surface 1504 for mounting the recording element substrate 1101. This slit 1502 is an opening into which a wiring tape portion 1301*a*, of the electric wiring tape 1301 held by the contact surface (holding surface) 1503, toward the external signal input terminal 1302 is insertable (FIG. 2).

In this embodiment, the electric wiring tape 1301 connected with the electrode portion 1104 of the recording element substrate 1101 can guide the wiring tape portion 1301*a* from the area surrounded by the contact portion 1310 to the outer surface of the casing of the ink retaining portion 1501 without inserting the contact portion 1310. The slit 1502 constitutes a guide portion for guiding the wiring tape portion 1301*a* to the outer surface of the casing of the ink retaining portion 1501 located outside the area surrounded by the contact portion 1310. For this reason, different from the conventional ink jet recording head, it is not necessary to provide the cap contact portion on the electric wiring tape, so that it is possible to reduce a size of the contact surface 1503 itself to a minimum level required for capping the recording element substrate 1101 without lowering close-contactness with the capping member 105.

Figure 5:
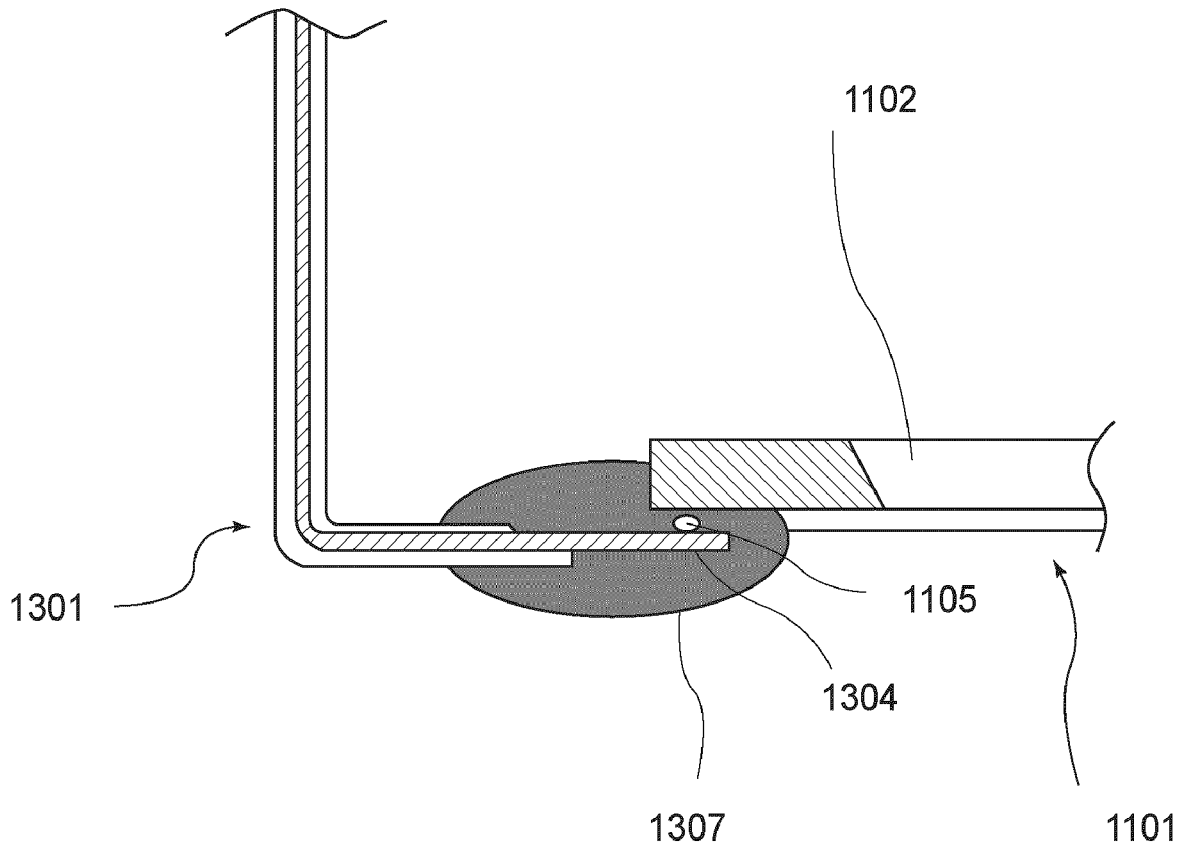
FIG. 5 is a partially sectional view of the ink jet recording head of the embodiment of the present invention.

For production of the ink jet recording head in this embodiment, first, the ink retaining portion 1501, the electric wiring tape 1301 and the recording element substrate 1101 are prepared. The electrode portion 1104 at the end of the recording element substrate 1101 and the electrode terminal portion 1304 at one end of the electric wiring tape 1301 are electrically connected. This electrically connected portion is sealed with a sealing agent 1306 (FIG. 5), thus being protected from corrosion by the ink and external impact. In other words, the sealing agent 1307 also functions as a protecting member. Thereafter, the electric wiring tape 1301 is bent 90 degrees. In this state, the electric wiring tape 1301 is bond-fixed with positional accuracy so that the ink supply ports 1102 of the recording element substrate 1101 communicate with the ink ejection outlet of the ink retaining portion 1501, respectively. As an adhesive 1307 used for the bonding, a thermosetting adhesive principally comprising epoxy resin is used. The other end of the electric wiring tape 1301 is inserted into the slit 1502 provided to the ink retaining portion 1501, so that an elongated portion of the electric wiring tape 1301 having the external input terminals 1302 penetrates through the slit 1502. A spacing between the electric wiring tape 1301 and the slit 1502 is filled with the sealing agent 1307. Incidentally, when the spacing is such a level that air passage through the spacing is substantially negligible in a state in which the electric wiring tape 1301 is inserted into the slit (opening) 1502, it is not necessary to fill the spacing with the sealing agent 1307.

The electric wiring tape 1301 is fixed at the side surface substantially perpendicular to the surface of the ink retaining portion having the ink ejection outlets 1201 by thermal caulking, bonding, or the like (FIG. 1).

As another production process, the electric wiring tape 1301 is not bent before it is bond-fixed to the ink retaining portion 1501 of the recording element substrate 1101. Specifically, the electric wiring tape 1301 connected with the recording element substrate 1101 is bent about 90 degrees while penetrating through the slit 1502 and then is positioned and bonded to the ink retaining portion 1501 of the recording element substrate 1101.

In a further production process, after the recording element substrate 1101 is positioned and fixed on the ink retaining portion 1501, the electric wiring tape 1301 bent about 90 degrees is positioned and electrically connected with the recording element substrate 1101 while being inserted into the slit 1502.

As shown in FIG. 1, the ink jet recording head 1001 includes a mounting guide 1560 for guiding the head 1001 to a mounting position of the carriage of the ink jet recording apparatus main assembly and an engaging portion 1930 for fixing the head 1001 to the carriage. Further, the ink jet recording head 1001 includes an abutting portion 1570 for positioning the head 1001 at a predetermined mounting position of the carriage with respect to X direction (carriage scanning direction), an abutting portion 1580 with respect to Y direction (recording medium conveying direction), and an abutting portion 1590 with respect to Z direction (ink ejection direction). The ink jet recording head 1001 is positioned by these abutting portions, so that the external signal input terminals 1302 on the electric wiring tape 1301 exactly electrically contact contact pins of the electrical connecting portion provided to the carriage. The ink jet recording head 1001 further includes the contact surface 1503 contactable with the capping member 105 of a refreshing unit 104 of the ink jet recording apparatus main assembly. The refreshing unit 104 clears ink clogging or the like in an ink passage communicating with the ink ejection outlet 1107 by sucking the ink from the ink ejection outlet 1107 in a state in which an open side of the ink ejection outlet 1107 is covered with the capping member, thus restoring the ink ejection state to a normal state.

Figure 6:
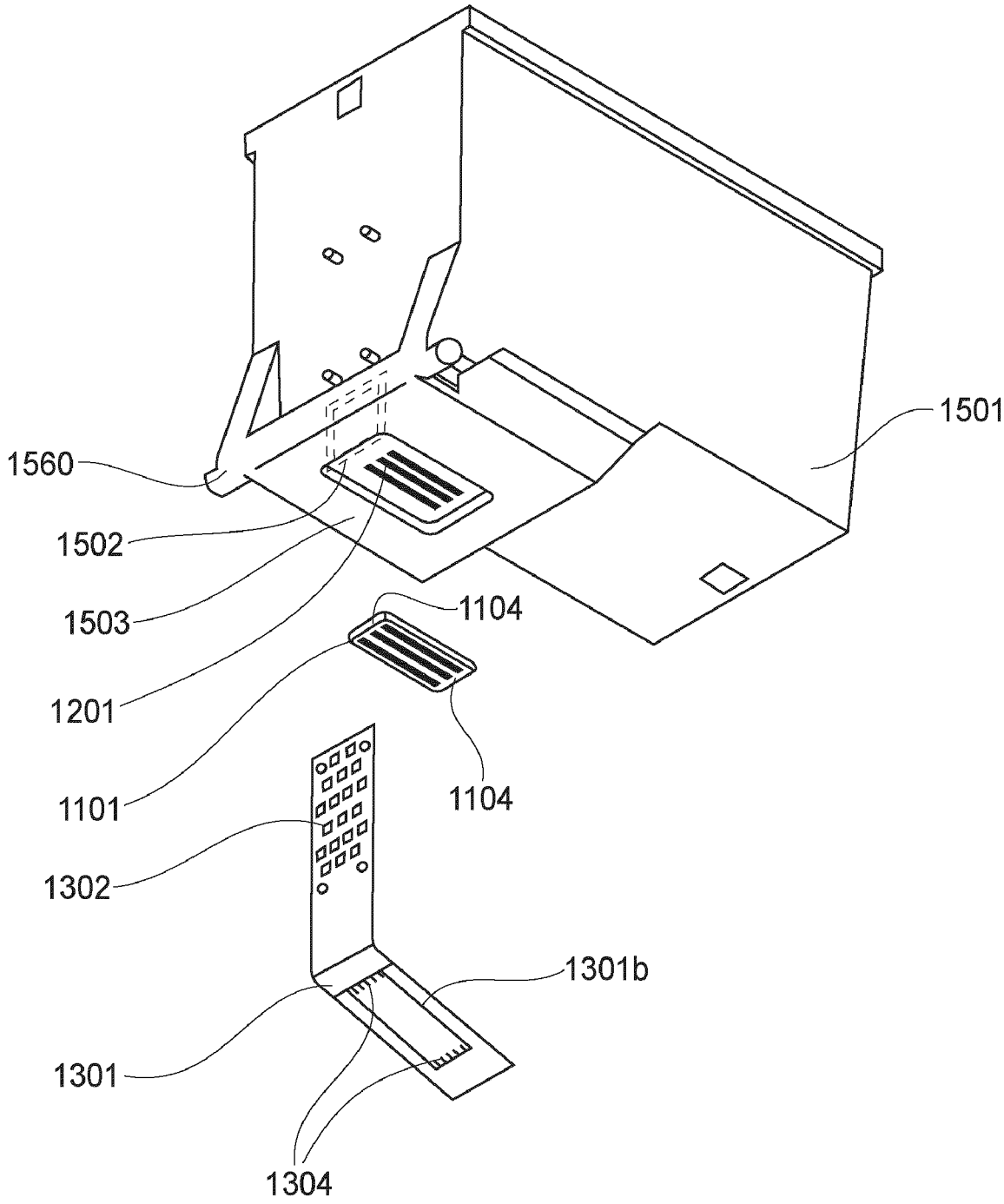
FIG. 6 is a perspective view showing a mounting side of a recording element substrate of the ink jet recording head when an electric wiring tape different from that shown in FIG. 1 is used.

A state of an ink jet recording head using another electric wiring tape when viewed from a mounting side of a recording element substrate is shown in FIG. 6. In this embodiment, an electric wiring tape 1301 has a size accommodatable within the contact portion 1310 and has an opening 1301*b* having a size in which the recording element substrate 1101 is accommodatable. In this constitution, two electrode terminal portions 1304 of the electric wiring tape 1301 are electrically connected with two electrode portions provided with opposing short sides of the recording element substrate 1101, respectively, to form two pairs of electrical connection portions. As a result, it is possible to effect electrical connection at two positions of the recording element substrate 1101, so that it is possible to form each of the electrode portions with a margin. Even in this case, the electric wiring tape 1301 can be led to the casing side surface of the ink retaining portion 1501 through the slit 1502 without intersecting the contact portion 1310.

The ink jet recording head 1001 may include an aluminum-made supporting member between the recording element substrate 1101 and the ink retaining portion 1501. In this case, the supporting member has an opening which communicates with the slit 1502 and through which the flexible (electric) wiring tape 1301 is inserted into the slit 1502. The supporting member has excellent temperature characteristics such as a low coefficient of linear thermal expansion and a high thermal conductivity with respect to the recording element substrate 1101 as the silicon substrate and the resinous casing of the ink retaining portion 1501. As a result, it is possible to realize stable mounting of the recording element substrate 1101 on the ink retaining portion 1501.

Figure 7:
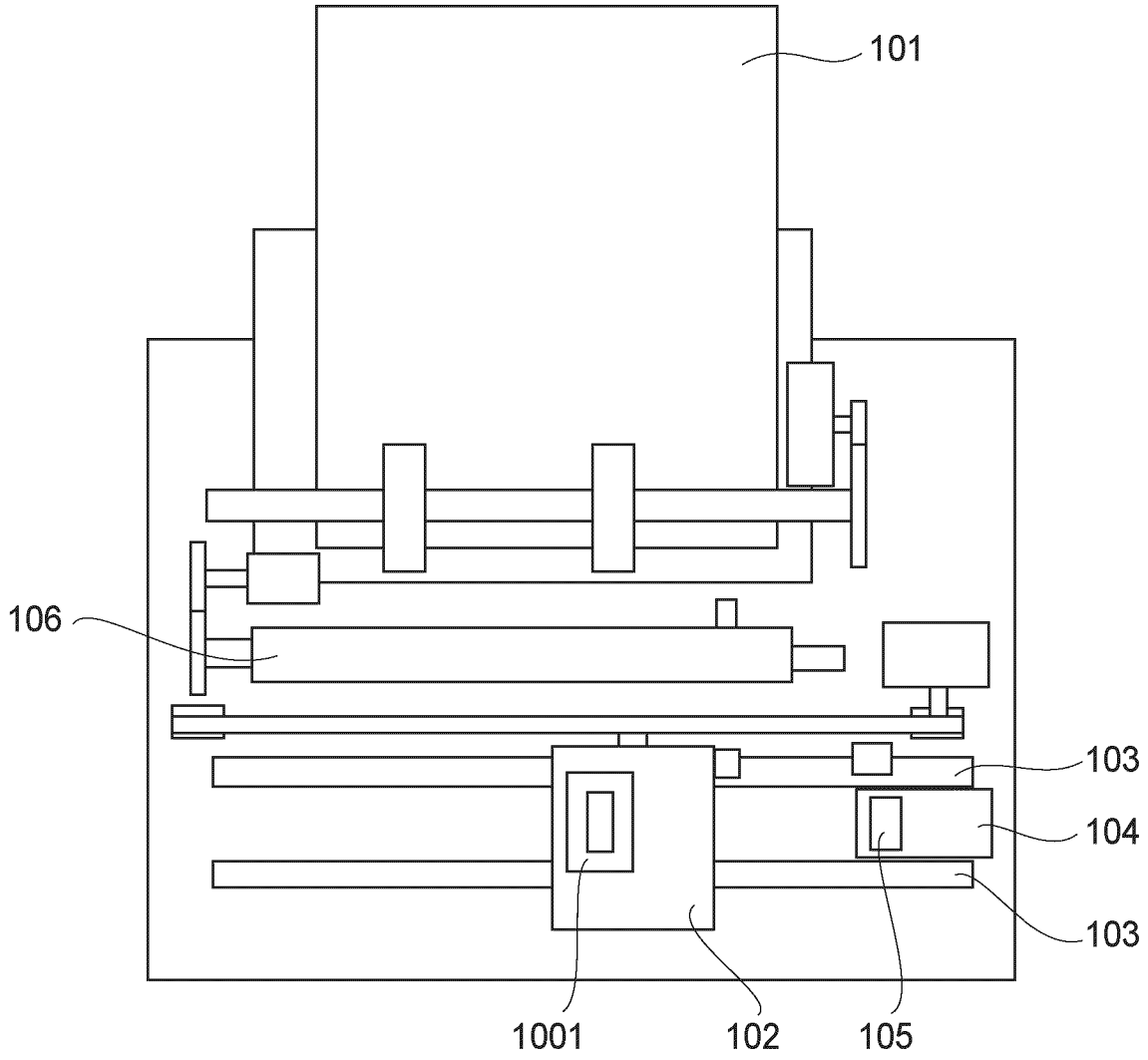
FIG. 7 is a schematic plan view showing an ink jet recording apparatus to which the ink jet recording head of the present invention is mounted.
Figure 8:
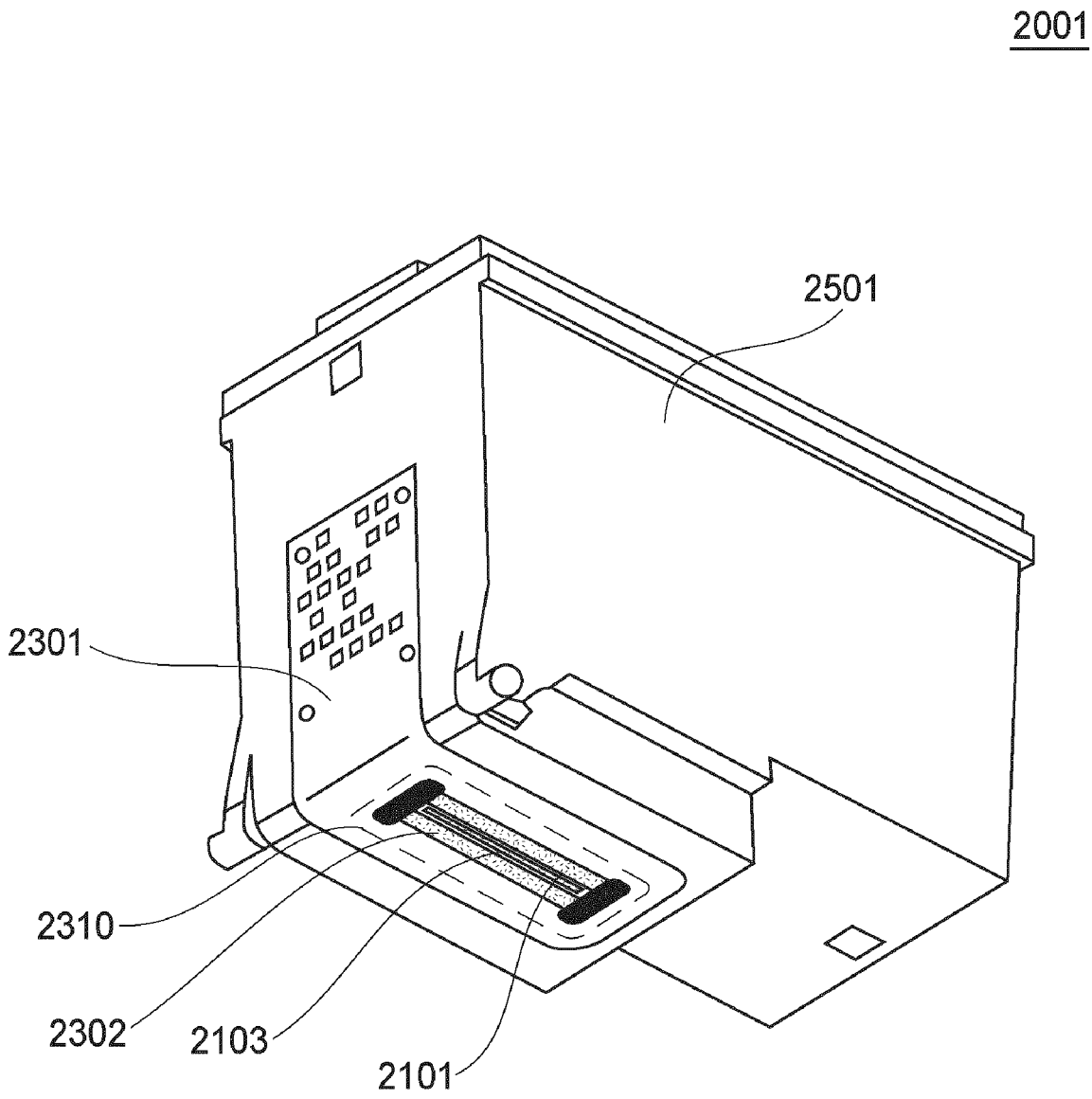
FIG. 8 is a perspective view showing a mounting side of a recording element substrate of a conventional ink jet recording head.

FIG. 7 is an explanatory view showing an embodiment of an ink jet recording apparatus to which the ink jet recording head of the present invention is mountable. On the carriage 102, the ink jet recording head 1001 shown in FIG. 1 is positioned and replaceably mounted. The carriage 102 is provided with an electrical connection portion for transmitting a driving signal or the like to each of electrothermal transducer elements through an associated external signal input terminal provided to the ink jet recording head 1001.

The carriage 102 is guided and supported reciprocably along a guide shaft 103 extended with respect to a main scanning direction and mounted to the ink jet recording apparatus main assembly. At a home position, the refreshing unit 104 provided with the capping member 105 for covering the ink ejection outlets 1107 of the ink jet recording head 1001 is disposed. The refreshing unit effects suction of the ink from the ink ejection outlets 1107 and capping or the like for preventing vaporization of the ink from the ink ejection outlets 1107. A recording medium 101 such as a sheet or a plastic thin plate or the like is conveyed (subjected to sub-scanning) through an opposing position with respect to the ink ejection outlets 1107 of the ink jet recording head 1001 by rotation of a conveying roller 106.

As described hereinabove, according to the ink jet recording head of the present invention, it is possible to form the contact surface at which the capping member can contact the ink retaining portion even when the head is downsized to such an extent that the contact surface with the capping member cannot be formed on the surface of the electric wiring tape (Flexible electric wiring substrate). As a result, it is possible to further reduce a production cost while keeping reliability of the ink jet recording head.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 341270/2006 filed Dec. 19, 2006, and No. 272677/2007 filed Oct. 19, 2007, which are hereby incorporated by reference herein.

What is claimed is:

1. An ink jet recording head comprising:

a recording element substrate provided with an energy generating element for generating energy for ejecting ink from an ink ejection outlet;

an electric wiring member electrically connected with said recording element substrate;

a mounting portion for mounting said recording element substrate; and an opening provided in said mounting portion, wherein said electric wiring member penetrates said opening, a contact surface, projected from said mounting portion in an ink ejection direction, is contactable with a capping member for covering the ink ejection outlet, said opening is located in an area surrounded by a contact portion of the contact surface contactable with the capping member, and a spacing between said electric wiring member and said opening is sealed by a sealing agent that is used for sealing an electrical connection portion between said recording element substrate and said electric wiring member.

2. An ink jet recording head comprising:

a recording element substrate provided with an energy generating element for generating energy for ejecting ink from an ink ejection outlet;

an electric wiring member electrically connected with said recording element substrate;

a mounting portion for mounting said recording element substrate;

a contact surface, projected from said mounting portion in an ink ejection direction, contactable with a capping member for covering the ink ejection outlet at a contact portion of said contact surface; and a guiding portion for guiding said electric wiring member from an area surrounded by said contact portion to outside of the area without intersecting said contact portion, said guiding portion being provided in said mounting portion in the area.

3. A head according to claim 2, wherein said guiding portion comprises a slit-like opening.

4. A head according to claim 2, wherein a spacing between said electric wiring member and said guiding portion is sealed by a sealing agent that is used for sealing an electrical connection portion between said recording element substrate and said electric wiring member.

* * * * *